US005643009A

United States Patent [19]

Dinkel et al.

[11] Patent Number: 5,643,009

[45] Date of Patent: Jul. 1, 1997

[54] ELECTRICAL CONNECTOR HAVING A PIVOT LOCK

[75] Inventors: Jeffrey Allen Dinkel; Richard E. Orstad, both of Greensboro; Michael Paul Trull, Winston-Salem, all of N.C.

[73] Assignee: The Whitaker Corporation, Wilmington, Del.

[21] Appl. No.: 606,709

[22] Filed: Feb. 26, 1996

[51] Int. Cl.[6] ..... H01R 13/424

[52] U.S. Cl. ..... 439/595; 439/596

[58] Field of Search ..... 439/595, 596, 439/744, 752

[56] References Cited

U.S. PATENT DOCUMENTS

| | | | |
|---|---|---|---|
| 3,838,382 | 9/1974 | Sugar | 439/595 |
| 4,045,110 | 8/1977 | Sterken | 339/91 R |
| 4,443,048 | 4/1984 | Moist, Jr. | 339/63 M |
| 4,544,220 | 10/1985 | Aiello et al. | 339/59 M |
| 4,583,805 | 4/1986 | Mantlik | 339/61 R |
| 4,660,915 | 4/1987 | Mantlik | 339/61 R |
| 4,758,183 | 7/1988 | Aoyama | 439/596 |
| 4,820,204 | 4/1989 | Batty | 439/681 |
| 4,900,277 | 2/1990 | Inaba et al. | 439/752 |
| 4,944,688 | 7/1990 | Lundergan | 439/275 |
| 4,973,268 | 11/1990 | Smith et al. | 439/752 |
| 4,979,913 | 12/1990 | Aiello et al. | 439/596 |
| 4,988,307 | 1/1991 | Muzslay | 439/188 |
| 5,076,806 | 12/1991 | Hotea et al. | 439/595 |
| 5,122,077 | 6/1992 | Maejima et al. | 439/398 |
| 5,501,619 | 3/1996 | Sakatani et al. | 439/596 |

*Primary Examiner*—David L. Pirlot
*Assistant Examiner*—Tho Dac Ta
*Attorney, Agent, or Firm*—Mary K. VanAtten

[57] ABSTRACT

The invention comprises an electrical connector having a connector housing with contact receiving passages to receive contacts therein and a guide member. A lock housing has a pivot member wherein the pivot member and the guide member cooperate to secure the lock housing to the connector housing and to allow the lock housing to rotate and move longitudinally with respect to the connector housing. The lock housing having a first position with respect to the connector housing wherein the contacts can be loaded into the housing. The lock housing having a second position wherein the contacts are secured within the housing for electrical connection with a matable connector.

11 Claims, 5 Drawing Sheets

ELECTRICAL CONNECTOR HAVING A PIVOT LOCK

FIELD OF THE INVENTION

The invention relates to an improved electrical connector housing and more particularly to an improved retention feature for the retention of the electrical contact within the housing.

BACKGROUND OF THE INVENTION

Typically electrical connectors have retention means within the housing in order to secure contacts therein. A primary method of retaining the electrical terminal within the housing is to have a stamped out lance from the electrical terminal metal body which abuts a shoulder within the housing. A typical secondary retention method is profiled as a plastic moveable member which can move into place over the contact to lock the contact in place. Some of these moveable members are moved transversely over the actual direction, while some are designed as hinged flaps which are rotated into place. These flaps include plastic tabs which, when rotated, reside in a groove or gap within the contact to retain the contact in place. The hinged flaps are typically integrally molded with the connector housing and have live hinges about which the flap rotates. The live hinge is a thin plastic member connecting the flap and the connector housing. The live hinge can become broken or worn out over time thereby making the flap useless as a retention device.

U.S. Pat. No. 5,076,806 shows an electrical connector having a secondary lock member which is attached to the connector body by a live hinge. The secondary lock rotates about the live hinge into the proper position whereby tabs secure the contacts in place within the connector housing.

It would be an advantage to provide a locking feature which is secured to the housing but does not contain a live hinge that can break or wear over time. It would be a further advantage to provide the locking feature to fully secure the contacts within the connector housing so that the contacts can be formed without lances. That is where the locking feature provides all the necessary retaining feature to keep the contact secured within the connector housing.

SUMMARY OF THE INVENTION

The invention comprises an electrical connector having a connector housing with contact receiving passages to receive contacts therein and a guide member. A lock housing has a pivot member wherein the pivot member and the guide member cooperate to secure the lock housing to the connector housing and to allow the lock housing to rotate and move longitudinally with respect to the connector housing. The lock housing having a first position with respect to the connector housing wherein the contacts can be loaded into the housing. The lock housing having a second position wherein the contacts are secured within the housing for electrical connection with a matable connector.

BRIEF DESCRIPTION OF THE DRAWINGS

Embodiments of the present invention will now be described with reference to the accompanying drawings in which.

DETAILED DESCRIPTION OF THE DRAWINGS

Figure 1:
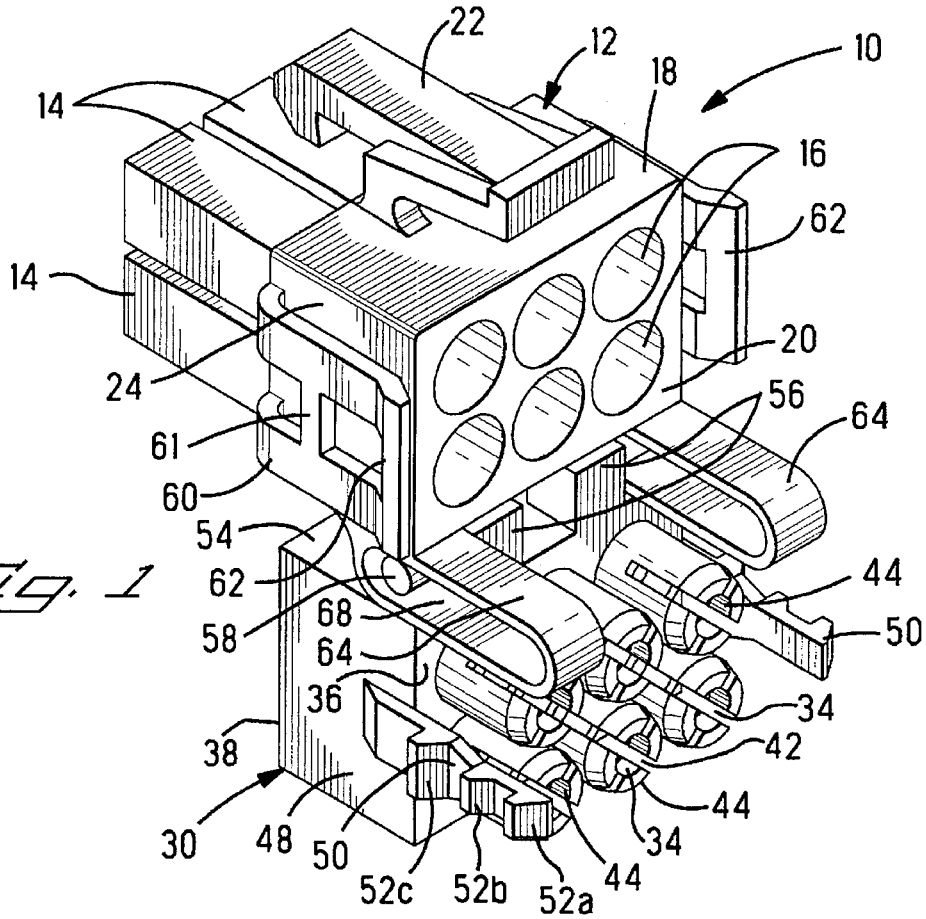
FIG. 1 is an isometric view of the connector of the present invention.
Figure 2:
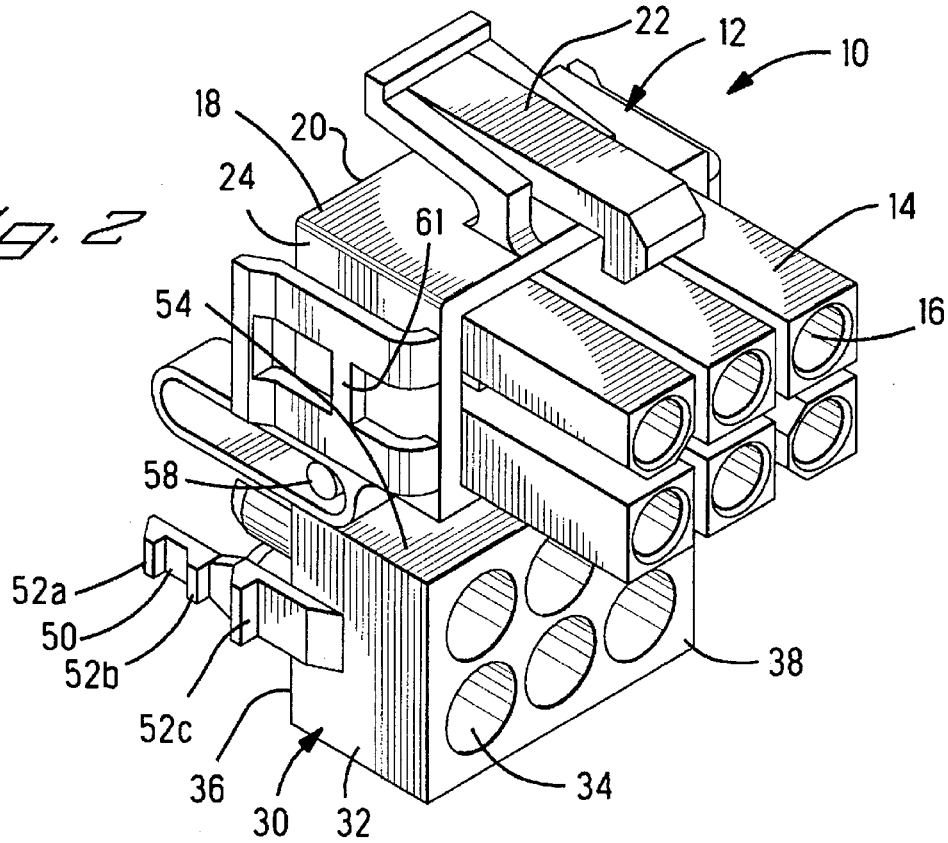
FIG. 2 is an isometric view taken from the front of the connector of the present invention.

FIGS. 1 and 2 show isometric views of the electrical connector of the current invention. The connector 10 has a main housing 12 and a pivot lock housing 30. The main housing is similar to other electrical connectors in that it has contact silos 14 extending from a main body 18. The main body 18 has a rearward end 20. Contact receiving passages 16 extend in the rearward end 20 forward through the contact silos 14. The contact silos can have polarization features as is shown in FIG. 2, however it is not necessary that these polarization features be present for the current invention. The main body also has a latching arm 22 which extends forward from the main body to connect the connector 10 with the matable connector not shown. The contact silos 14 are designed to be received within openings in the matable connector also not shown. The main body 18 further has sidewalls 24. It is to be understood that other configurations of the main body of the electrical connector can have many different configurations and arrangements. For example, it is not necessary that the main body have a latching arm 22 or that the main body have contact silos 14 such as shown.

Figure 9:
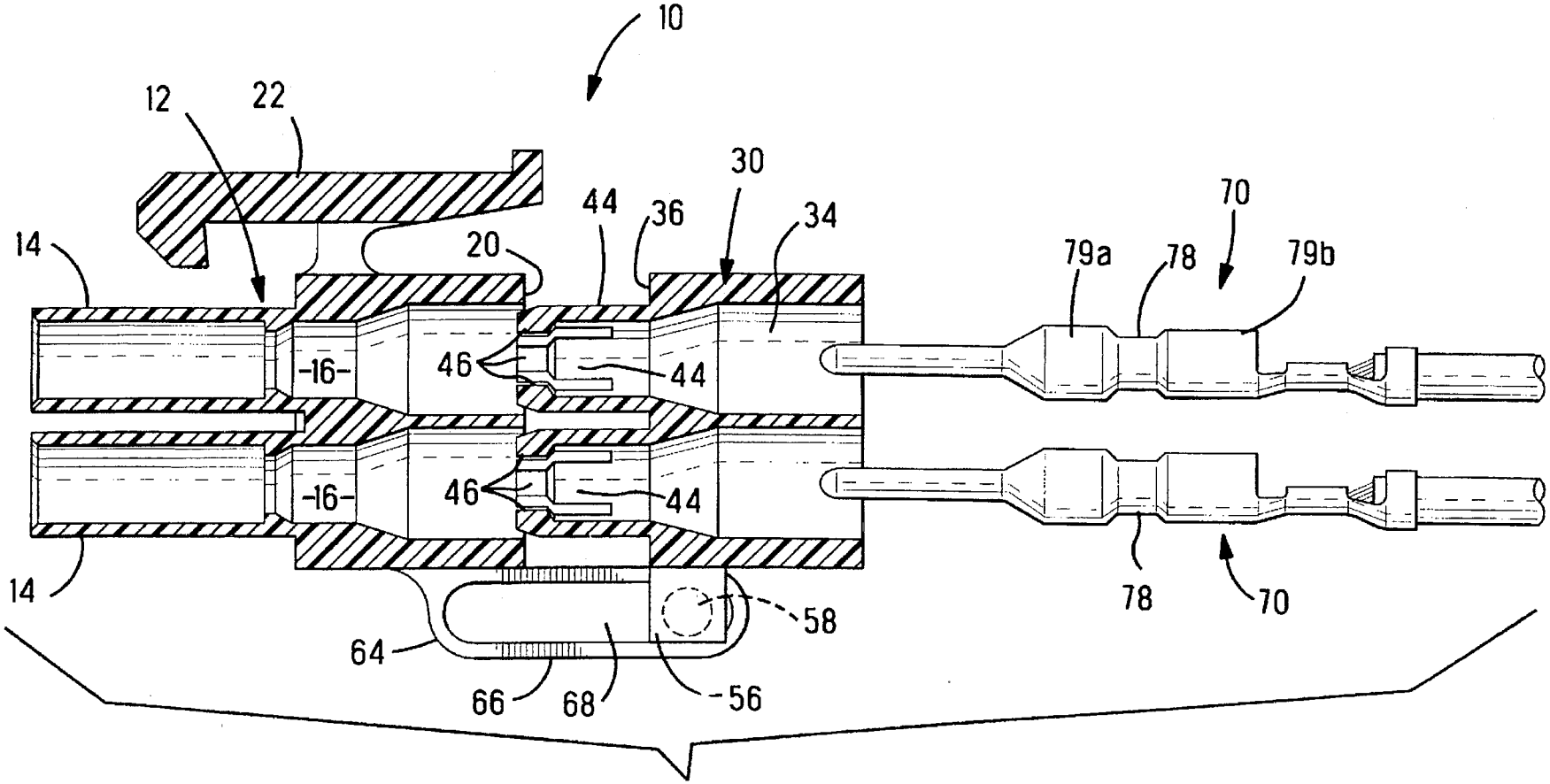
FIG. 9 is a cross sectional view showing the pivot lock housing in the prestage position.

The connector 10 also has a pivot lock housing 30 having a main body 32. The main body 32 has a forward end 36 and a rearward end 38. Second contact silos 40 extend forwardly from the forward end 36. Second contact receiving passages 34 extend from the rearward end 38 through the contact silos 40. The contact silos 40 differ from the contact silos 14 on the main housing in that the contact silos 40 have slots 42 extending from the most forward end partially through towards the main body 32. These slots 42 form resilient latching fingers 44 on the silo. The resilient latching fingers have protrusions 46 which extend inwardly towards the center of the contact silo as is best shown in FIG. 9. The main body 32 also has sidewalls 48 each with an arm 50 extending forwardly therefrom. The arm 50 extends beyond the forward end 36 of the main body 32 and extends parallel to the contact silos 40. Each arm 50 has several ratchet teeth **52*a*, 52*b*, 52*c* extending outwardly therefrom. Each ratchet tooth has a forwardly facing ramp surface and a rearwardly facing flat surface for engaging a latching arm. The main body 32 also has a top wall 54 with block projections 56 extending upwardly therefrom. The block projections 56 each have a pivot pin 58 extending outwardly therefrom. The pivot pin 58 extends towards the sidewall 48**.

The main housing 12 has two resilient latching arms 60 extending from sidewall 24. Each resilient arm 60 extends towards the rearward end 20 of the main housing 12. Each of the latching arms 60 has two parallel arms with recesses therebetween. A cross bar 61 extends perpendicularly between the two parallel arms and a latching bar 62 runs perpendicular along the rearward portion of the resilient latching am 60 between the two parallel arms. The latching bar 62 and the cross bar 61 are perpendicular to the main direction of the latching arm.

The main housing 12 also has a bottom wall 26 which is opposite to the mating latching arm 22. The bottom wall 26 has two pivot guide members 64 extending rearwardly therefrom. The pivot guide 64 has an outer loop 66 with a recess 68 therein. The pivot guide 64 extends beyond the rearward end 20 of the main housing 12. The pivot guide 64 receives the pivot pin 58 from the pivot lock housing 30 such that the pivot pin can move within the pivot guide both longitudinally and rotationally.

The connector 10, having both the main housing 12 and the pivot lock housing 30, is molded in a one step process such that the pivot pins 58 are formed within the pivot guide 64 but not as an integral part of the pivot guide. Therefore, the main housing 12 and the pivot lock housing 30 are separate pieces that can move with respect to each other but are formed in one process. No separate assembly of the individual pieces is necessary.

Figures 3, 4:
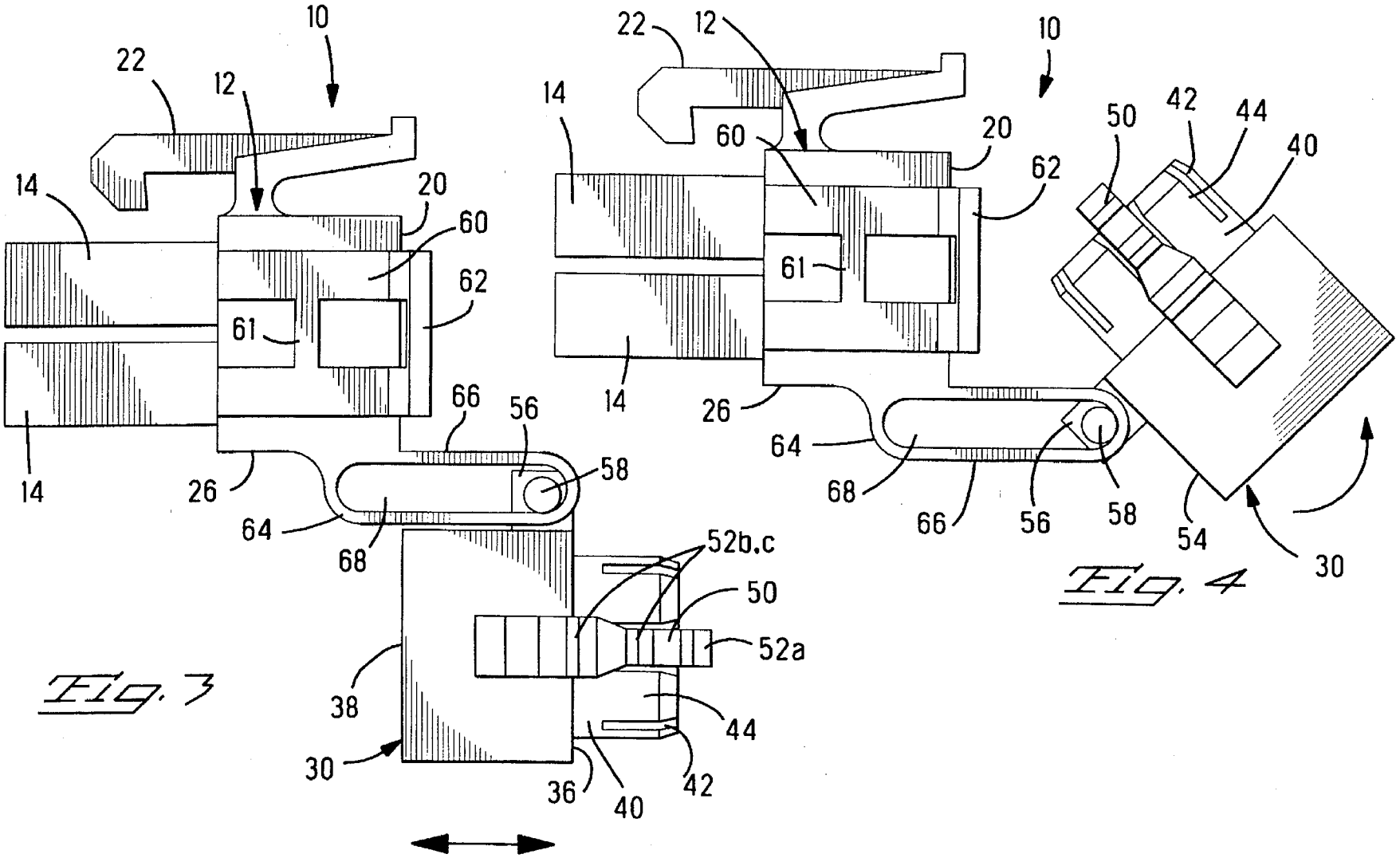
FIG. 3 is a side view of the connector showing the longitudinal movement of the pivot lock housing.
FIG. 4 is a side view showing the rotational movement of the pivot lock housing.

FIGS. 3 and 4 illustrate how the pivot lock housing 30 can move with respect to the main housing 12. The pivot pins 58 are received within the pivot guide 64 such that the pivot pins can move longitudinally therefore moving the pivot lock housing 30 with respect to the main housing 12, as is shown in FIG. 3 by arrow A. The cooperation of the pivot pin 58 and the pivot guide 64 also allows the pivot lock 30 to rotate about the pivot pin 58, as is shown in FIG. 4 by arrow B. The pivot pin 58 can move freely within the recess 68 of the pivot guide 64. The pivot pin only being constrained by the outer loop 66 of the pivot guide 64.

Figure 5:
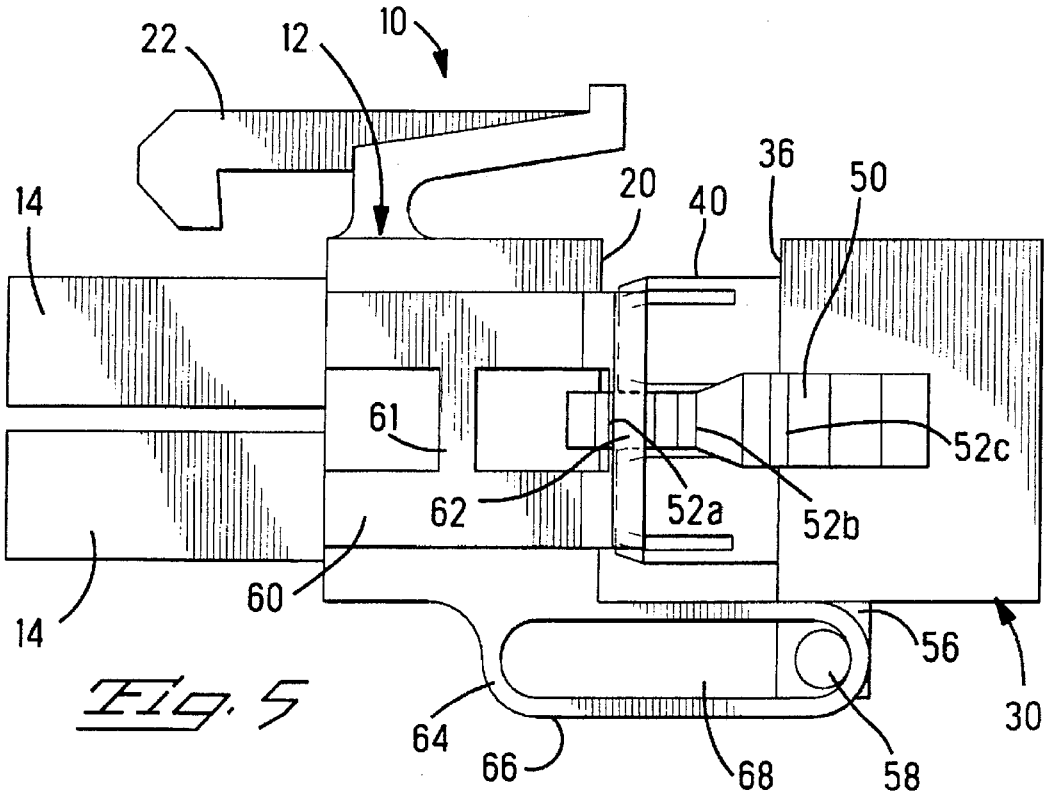
FIG. 5 is a side view showing the prestage position of the pivot lock housing.

FIG. 5 shows the pivot lock housing 30 in a prestage position. In this position the pivot lock housing 30 is rotated around so that it is in alignment with the main housing 12. Further, the forwardmost ratchet tooth **52*a* on the arm 50 engages the latching bar 62 on the resilient arm 60 of the main housing. That is the ratchet tooth is received in front of the latching bar 62** thereby securing the pivot lock in this prestage position. The significance of the prestage position will be described later on with reference to later figures.

Figure 6:
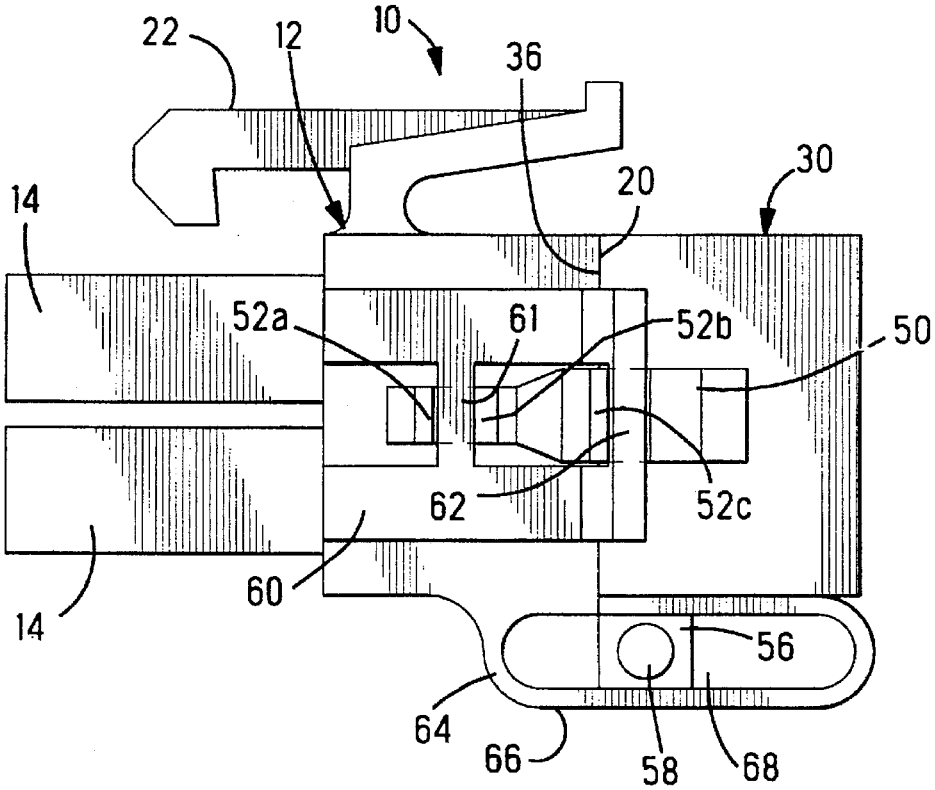
FIG. 6 is a side view showing the fully assembled position of the pivot lock housing.

FIG. 6 shows the pivot lock housing 30 moved into the final fully locked position. The pivot lock housing 30 is pushed forward against the main housing 12 such that the most forward ratchet tooth **52*a* is received past the crossbar 61 on the latching am 60. The middle ratchet tooth 52*b* is received on the opposite side of the crossbar through the recess on the latching arm 60. Further the third ratchet tooth 52*c* is received also within the recess on the latching am 60. The third ratchet tooth 52*c* engages the latching bar 62 thereby double locking the pivot lock housing 30 in place against the main housing 12. The forward end 36 of the pivot lock housing 30 is abutted against the rearward end 20 of the main body 12**.

Figure 7:
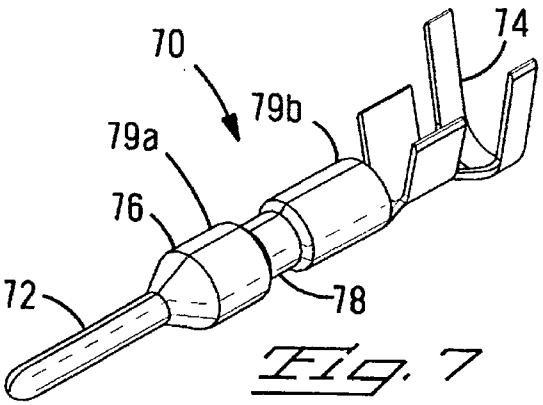
FIG. 7 is an isometric view of the pin contact.
Figure 8:
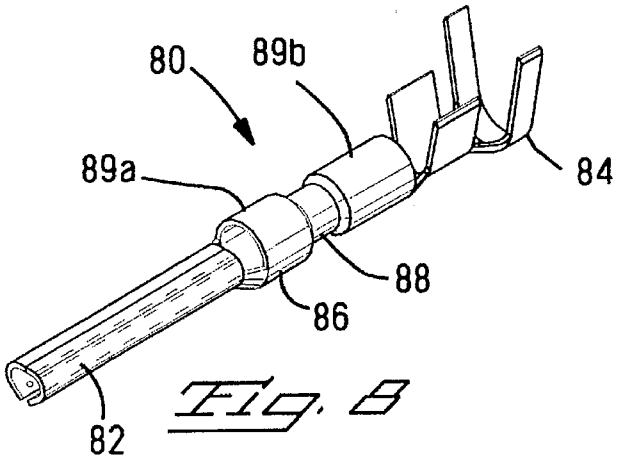
FIG. 8 is an isometric view of the socket contact.

The connector 10 of the present invention can accommodate both pin contacts 70 and socket contacts 80. The pin contact is shown in FIG. 7 and has a mating portion 72 and a crimp portion 74. An intermediate portion 76 has a narrow section 78 with wider sections **79*a* and 79*b* both forward and behind the narrow sections 78. Similarly the socket contact in FIG. 8 has a mating portion 82 and a crimp portion 84. The intermediate portion 86 also has a narrow portion 88 which is flanked by wider portions 89*a* and 89*b*** both to the rear and forward of the narrow portion.

FIG. 9 shows the connector 10 in a cross sectional view where the pivot lock housing 30 is in the prestage position. That is where the first ratchet tooth **52*a* has engaged the latching bar 62 on the housing. The contact 70 is inserted from the rearward end 38 of the pivot lock housing, such that the contacts are received into the contact receiving passageway 34**.

Figure 10:
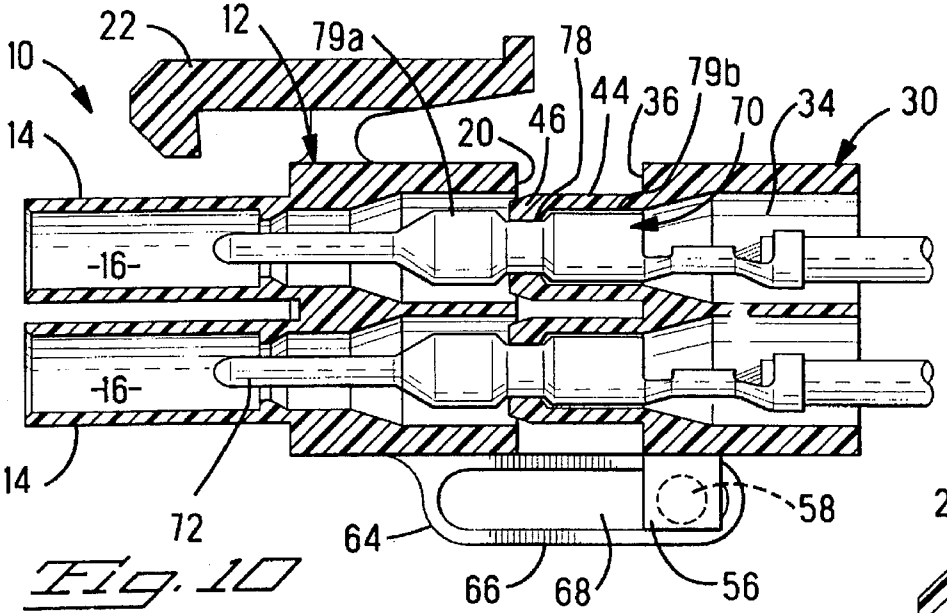
FIG. 10 is a cross sectional view showing the pivot lock housing in the prestage position and the contacts loaded within the pivot lock housing.

FIG. 10 shows the contacts fully loaded into the electrical connector 10 with the pivot lock housing 30 in the prestage position. As can be seen, the contact 70 is received into the main housing 12 such that it is received through the contact receiving cavity 16. The protrusions 46 of the resilient latching fingers 44 are received within the narrow portion 78 of the contact 70. The resilient fingers 44 are deflected outwardly during the insertion of the contact as the wider portion **79*a* is being received through the resilient fingers. The resilient fingers 44 then resile back to their initial position thereby securing the contact in the pivot lock housing 30. The contact is prevented from moving forward in the housing because the wider portion 79*b*** along the rear of the contact engages protrusions thereby preventing the contacts from being moved forward in the housing.

Figure 11:
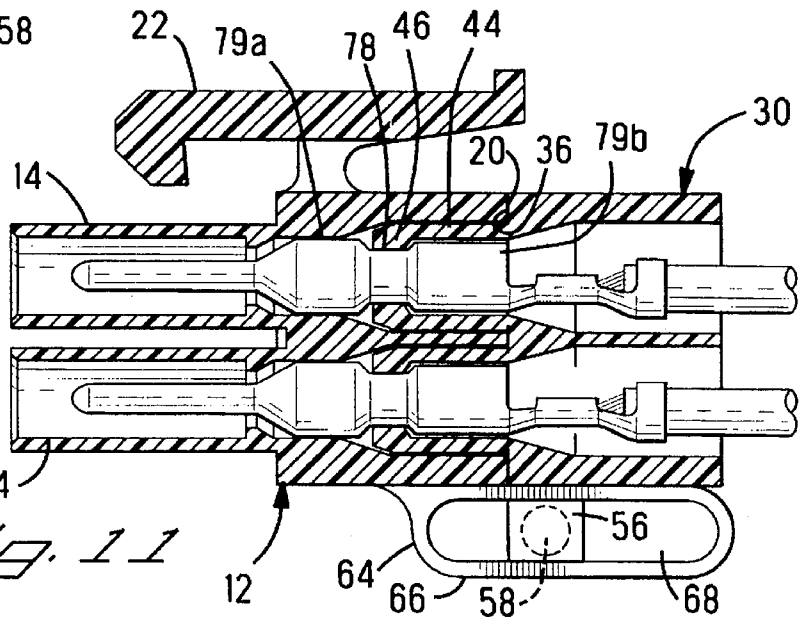
FIG. 11 is a cross sectional view showing the fully assembled connector.

FIG. 11 shows the pivot lock housing 30 in the fully assembled position that is where the third ratchet tooth **52*c* has been pushed into a position where it is engaging the latching bar 62. This is known as the fully assembled position. In this position, the second contact silos 40 on the pivot lock housing 30 are fully received within the contact receiving passages 16. The forward end 36 of the pivot lock housing 30 is received against the rearward end 20 of the main housing 12. Further, the mating portion 72 of the contact 70 is received into the portion of the contact receiving cavity 16 which resides in the contact silo 14 for electrically connecting with contacts in a matable connector (not shown). As can be seen in the drawings, the contact receiving passageway 16 becomes narrower as it approaches the contact silos 14. When the connector is in the fully assembled position, the contact 70 is prevented from moving forward in the passageway because the wider portion 79*a* of the contact 70 engages the narrower portion of the contact receiving cavity 16 and is therefore prevented from being pushed more forward. Further, the resilient latching fingers 44 are securely held within the contact receiving passageway 16 thereby preventing them from deflecting outwardly. Therefore, the rearward wider portion 79 cannot move past the resilient latching fingers. The contact 70 is also prevented from being moved in a backward motion within the connector for the same reason. Because the resilient fingers 44 are prevented from deflecting outwardly by the contact receiving passageway 16, it is impossible for the wider portion to move through the latching fingers 44 past the protrusion 46. Therefore, the contact is fully secured within the passageway and is prevented from moving either forwardly or rearwardly within the contact. The pivot lock housing 30 is also prevented from being moved because it is secured by the resilient latching am 60. In order to remove the contacts from the housing, it is necessary to unlatch the pivot lock housing 30 from main body 12 and move the pivot lock housing 30 into the prestage position. The contacts 70 can then be removed and replaced. Because the pivot lock housing 30** is not connected to the main body by a living hinge, it is reusable any number of times without damaging the locking housing due to overuse.

The electrical connector 10 can also accommodate socket contacts 80 in a similar manner as the pin contacts 70. The socket contacts 80 are secured within the housing in the same manner.

The advantages of the present invention are that the contacts can be secured within the housing both from forward and rearward movement without using lances on the contacts. Further, the locking mechanism used to secure these contacts within the housing is formed integrally with the housing and can be used over again. That is the pivot pin in freely moveable within the pivot guide therefore allowing the pivot lock housing 30 to be moved inward and outward of the main housing without damaging the guiding mechanism. A further advantage is that the pivot lock is formed at the same time as the main housing and no assembly of the pivot lock is necessary.

An additional advantage of the present invention is that because the locking fingers prevent the contact from moving rearwardly or forwardly, the contacts have a true position assurance for mating. The locking fingers prevent lateral movement of the contact if the wires which extend from the connector are pulled laterally, thereby keeping the contacts in the correct position for mating. If the contacts are pulled out of alignment, the contacts can stub against the contacts of the matable connector thereby preventing proper mating. The present invention insures that the contacts are maintained in the proper position for mating.

It is thought that the improved electrical connector of the present invention and many of its attendant advantages will be understood from the foregoing description. It is apparent that various changes may be made in the form, construction, and arrangement of parts thereof without departing from the spirit or scope of the invention, or sacrificing all of its material advantages.

We claim:

1. An electrical connector comprising:

a connector housing having contact receiving passages to receive contacts therein and a guide member;

a lock housing having a pivot member wherein the pivot member and the guide member cooperate to secure the lock housing to the connector housing and to allow the lock housing to rotate and move longitudinally with respect to the connector housing, the lock housing having a first position with respect to the connector housing wherein the contacts can be loaded into the housing, the lock housing having a second position wherein the contacts are secured within the housing for electrical connection with a matable connector.

2. The electrical connector of claim 1, wherein the guide member has a recess, the pivot being received within the recess.

3. The electrical connector of claim 2, wherein the guide member has an outer loop which encompasses the recess, the guide member extending rearwardly from the connector housing.

4. The electrical connector of claim 1, wherein the lock housing has a rearward end and a forward end with contact silos extending from the forward end, and contact receiving passages extend through the lock housing from the rearward end through the contact silos.

5. The connector of claim 4, wherein the contact silos having latching fingers with protrusions on ends thereof, the latching fingers being deflectable to receive the contacts and secure the contacts thereon.

6. The electrical connector of claim 5, wherein the contact silos are receivable within the contact receiving passages of the connector housing.

7. The electrical connector of claim 6, wherein the lock housing has an arm with ratchet teeth thereon, the arm extending forwardly from the lock housing, and the connector housing has a resilient latching arm to engage the ratchet teeth.

8. The electrical connector of claim 7, wherein the first position is a prestage position where the ratchet teeth engage the resilient latching arm and the contacts being inserted through the contact receiving passages of the lock housing, the latching fingers being deflectable to receive the contacts and then resile to their normal position to secure the contacts therein, the second position being a fully assembled position wherein the contact silos are received within the contact receiving passages of the connector housing thereby preventing deflection of the latching fingers and securing the contacts therein and the resilient latching arm cooperates with the ratchet teeth to secure the lock housing in the fully assembled position.

9. The electrical connector of claim 1, wherein the lock housing has an arm with ratchet teeth thereon, the arm extending forwardly from the lock housing, the connector housing having a resilient latching arm to engage the ratchet teeth, the resilient latching arm and the ratchet teeth on the arm cooperate to secure the lock housing in the first position wherein the contacts can be removably loaded into the lock housing, the resilient latching arm and the ratchet teeth on the arm further cooperate to secure the lock housing in the second position in which the contacts are fully secured within the connector housing for mating with the matable connector.

10. The electrical connector of claim 9, wherein the lock housing has a rearward end and a forward end with contact silos extending from the forward end, and contact receiving passages extend through the lock housing from the rearward end through the contact silos.

11. The electrical connector of claim 10, wherein the contact silos have latching fingers with protrusions thereon, the latching fingers being deflectable while in the first position to receive the contacts therein, and when the pivot housing is in the second position, the contact silos are received within the contact receiving passages of the connector housing thereby preventing deflection of the latching fingers and preventing the contacts from being removed from the connector housing.

* * * * *